US008093821B2

(12) United States Patent
Loo et al.

(10) Patent No.: US 8,093,821 B2
(45) Date of Patent: Jan. 10, 2012

(54) DRIVING METHOD FOR IMPROVING LUMINOUS EFFICACY OF A LIGHT EMITTING DIODE

(75) Inventors: Ka Hong Loo, Hong Kong (HK); Wai Keung Lun, Hong Kong (HK); Yuk Ming Lai, Hong Kong (HK); Siew Chong Tan, Hong Kong (HK); Chi Kong Michael Tse, Hong Kong (HK)

(73) Assignee: The Hong Kong Polytechnic University, Kowloon (HK)

( * ) Notice: Subject to any disclaimer, the term of this patent is extended or adjusted under 35 U.S.C. 154(b) by 437 days.

(21) Appl. No.: 12/366,304

(22) Filed: Feb. 5, 2009

(65) Prior Publication Data

US 2010/0194300 A1 Aug. 5, 2010

(51) Int. Cl.
*H05B 37/02* (2006.01)

(52) U.S. Cl. ..... 315/209 R; 315/170

(58) Field of Classification Search ..... 315/209 R, 315/160, 170, 172
See application file for complete search history.

(56) References Cited

U.S. PATENT DOCUMENTS

| | | | | |
|---|---|---|---|---|
| 7,126,290 | B2 * | 10/2006 | Elliott | 315/312 |
| 7,394,444 | B2 | 7/2008 | Kim et al. | |
| 2010/0244707 | A1 * | 9/2010 | Gaines et al. | 315/152 |

* cited by examiner

*Primary Examiner* — Daniel D Chang
(74) *Attorney, Agent, or Firm* — Muncy, Geissler, Olds & Lowe, PLLC

(57) ABSTRACT

A driving method for improving luminous efficacy of a light emitting diode (LED), the method comprising: periodically switching a DC current supplied to the LED between a high current level $I_H$ and a low current level $I_L$, the low current level $I_L$ being fixed at zero or raised above zero to produce a DC offset; and maintaining an average current at a first value $\overline{I_f}$ by adjusting the duty cycle acting on the high current level $I_H$ and any one from the grouping consisting of: adjusting the high current level $I_H$ and adjusting the low current level $I_L$, and adjusting the high current level $I_H$ or adjusting the low current level $I_L$.

17 Claims, 13 Drawing Sheets

(a)

(b)

(a)

(b)

(a)

(b)

DRIVING METHOD FOR IMPROVING LUMINOUS EFFICACY OF A LIGHT EMITTING DIODE

TECHNICAL FIELD

The invention concerns a driving method and driving system for improving luminous efficacy of a light emitting diode (LED).

BACKGROUND OF THE INVENTION

Due to the enormous progress recently achieved in the solid-state lighting technology, light-emitting diodes (LEDs) are now approaching the luminous performance level of those provided by conventional light sources while offering substantially longer operational lifetime, superior lumen maintenance, and color-rendering property with improved reliability and handling safety compared to light bulbs and fluorescent tubes. Due to the very low operating voltage of LEDs, lamp drivers are relatively simple to design and more reliable due to smaller stresses on driver components compared to fluorescent lamps which require high starting voltage and precise control of heating current for filament both during the start-up phase and dimming action. Therefore, the use of LEDs is becoming more popular and is quickly replacing incandescent, halogen, and fluorescent lamps in residential, commercial, and industrial applications.

With LEDs being increasingly used in different illumination applications, the necessity for an efficient driver with an optimized control circuitry becomes more important. Since LEDs are current-driven devices in which light is produced via the recombination of injected holes and electrons in a semiconductor junction, the luminous intensity of LEDs is typically controlled by controlling the forward current flowing through the device. Since LEDs conduct current only in one direction, the default method for driving LEDs is by using a constant DC current, known as amplitude-mode driving technique. Nevertheless, it is found that the peak emission wavelength of LEDs tend to shift with the forward current which can lead to color variations at different luminosity levels. This problem imposes significant challenge when the LEDs are used for LCD backlighting where color stability is of primary importance. White light can be produced by combining the three primary colors each generated by individual LEDs, or by using phosphor conversion of blue or UV LEDs, all of which are prone to color variations when driven at different forward currents. This makes the amplitude-mode driving technique unsuitable for use in dimming LEDs as the forward current must be continuously adjusted for various luminosity levels. Even when operated without dimming, the small dynamic resistance of LEDs also imposes stringent requirement on the control accuracy of the DC current as ripple effect can also lead to the same color variation problem. Also, when driving multiple LEDs, the number of LEDs connected in series is limited by the output voltage available from the DC power source and often necessitates the use of step-up voltage conversion stage. For LEDs connected in parallel, unequal current sharing between the LED branches due to the manufacturing spread, aging and temperature variations also leads to spatial variations in the luminous intensity and color. Furthermore, one of the most attractive features of LEDs is their extremely long lifetime hence the LED drivers should also have a comparable lifetime. However, the electrolytic capacitors typically used at the output of DC power source have placed limitation on the lifetime of these drivers, especially when the drivers have to operate continuously under high ambient temperature such as inside the light fixture or close to the high-power LEDs.

Some of the problems discussed above can be eased by driving the LEDs with AC current. If the mains power is used directly as the power source, AC current can be supplied to the LEDs without further power conversion stage. This substantially reduces the cost and improves the lifetime of the LED driver due to the absence of electrolytic capacitor. Since LEDs are uni-polar devices, this type of driver should be used for driving LEDs arranged in anti-parallel (or full-bridge LED module) so that light is obtained at both half cycles of the AC current. However, as the LED current flowing through each branch is pulsating at 50 or 60 Hz, the light quality can be significantly degraded due to flickering. To eliminate this problem, high-frequency AC current is used but this requires an intermediate AC-AC power conversion stage which overwrites the advantage of a simple mains AC driver and makes other driving techniques more attractive, such as pulsating DC. With AC current, the LEDs can be dimmed by sampling the AC current at regular intervals through on-off switching at a substantially higher frequency than the fundamental AC current. Thus it is expected that driving LEDs with pulsating current conveniently achieves both the LED powering and dimming functions.

The technique of driving LEDs with pulsating DC current is more commonly known as the burst-mode or pulse-width-modulation (PWM) driving technique. This is a method by which the LED is switched on and off at high frequency and the luminous intensity is controlled by adjusting the duty cycle, the ratio of the time the device is on to the switching period, hence the average forward current. Since the peak current level is kept constant during the switching, the control of luminosity level by dimming is independent of the color thus the light chromaticity is improved. In practice, some ripples are often present in the peak current and it should be minimized so that the average driving current can be controlled precisely, especially when the LEDs are used as LCD backlight. Despite improved chromaticity and flexibility for dimming, the PWM drivers are inherently more complicated since a combination of DC power source (AC-DC or DC-DC converters) and switching network is usually needed, which increases the driver complexity. Fast transients produced by the switching of LED current also cause EMI problems, which must be overcome by additional EMC design at increased cost.

Among the three driving techniques discussed, amplitude-mode and PWM-mode driving are most commonly adopted by the LED industry. The interactions between the current waveforms used (DC and PWM) and the luminous characteristics of LEDs are rarely discussed. The luminous intensity of LEDs tends to saturate at high forward current. This feature gives rise to different luminosity levels when the LED is driven by DC and PWM currents of the same average value. Generally, for a given average forward current, amplitude-mode driving technique always produces a higher luminous intensity compared to the PWM-mode driving technique since the latter operates at higher peak current level where less light is produced due to the saturation phenomenon. When linearly averaged by the duty cycle, this results in a lower luminous intensity. However, with better chromaticity and flexibility for dimming, the PWM-mode driving technique is preferred and more often used in practice where dimming is required at the expense of poorer luminous efficacy.

SUMMARY OF THE INVENTION

In a first preferred aspect, there is provided a method for improving luminous efficacy of a light emitting diode (LED), the method comprising:

periodically switching a DC current supplied to the LED between a high current level $I_H$ and a low current level $I_L$, the low current level $I_L$ being fixed at zero or raised above zero to produce a DC offset; and maintaining an average current at a first value $\overline{I}_f$ by adjusting the duty cycle acting on the high current level $I_H$ and any one from the grouping consisting of:

adjusting the high current level $I_H$ and adjusting the low current level $I_L$, and adjusting the high current level $I_H$ or adjusting the low current level $I_L$.

The high current level $I_H$ may be maintained and the low current level $I_L$ is increased and the duty cycle acting on the high current level $I_H$ is reduced to maintain an average current at the first value $\overline{I}_f$.

The low current level $I_L$ may be maintained and the high current level $I_H$ is reduced and the duty cycle acting on the high current level $I_H$ is increased to maintain the average current at the first value $\overline{I}_f$.

The low current level $I_L$ may be increased and the high current level $I_H$ is reduced at the same time and the duty cycle acting on the high current level $I_H$ is adjusted to maintain an average current at the first value $\overline{I}_f$.

The LED may be driven by two independent power sources, each being set to deliver the high current level $I_H$ and the low current level $I_L$ respectively, and an independent switching network is used to adjust the duty cycle acting on the high current level $I_H$.

The LED may be driven by a single power source with two output voltages.

In a second aspect, there is provided a driving system for improving luminous efficacy of a light emitting diode (LED), the system comprising:

a switching network to periodically switch a DC current supplied to the LED between a high current level $I_H$ and a low current level $I_L$, the low current level $I_L$ being fixed at zero or raised above zero to produce a DC offset; and to maintain an average current at a first value $\overline{I}_f$ by adjusting the duty cycle acting on the high current level $I_H$ and any one from the grouping consisting of:

adjusting the high current level $I_H$ and adjusting the low current level $I_L$, and adjusting the high current level $I_H$ or adjusting the low current level $I_L$.

To retain the color stability and dimming flexibility, PWM mode is employed to switch the LED current between two levels, which forms the dominant current component of the device. To partially compensate for the degradation in the luminous intensity due to duty-cycle averaging in the PWM mode, the lower level of the PWM current is fixed at zero or raised above zero while the higher current level is lowered and the duty cycle is adjusted accordingly for a given average current. The narrowing in the difference between the two current levels is fundamental to the improvement in the luminous intensity of the LED. As the modified PWM current waveform starts to deviate from the simple on-off pulses encountered in conventional PWM mode towards a DC current by having the two current levels approach each other from opposite directions, the detrimental effect of the duty-cycle averaging in conventional PWM mode can be gradually compensated and higher luminosity is obtained. The modified PWM is referred to as the bi-level current driving technique.

Luminous efficacy is a measure of the luminous flux produced by a light source per unit of electrical power input. The unit of luminous flux is lumen (lm) and the unit of electrical power input is watt (W). The luminous flux per unit illuminated area is called the illuminance and the unit is lumen per square meter (lm $m^{-2}$) or lux (lx) so the luminous efficacy can also be defined in terms of the illuminance efficacy (lx $W^{-1}$).

The present invention provides a method which generally improves the degree of brightness or visual response of human eyes under illumination. The invention is not limited to the measurement units discussed but also to all measurement units which are used for similar purposes or convey similar meanings.

BRIEF DESCRIPTION OF THE DRAWINGS

An example of the invention will be described with reference to the accompanying drawings, in which:

FIG. 1(*b*) is a schematic diagram of a driving methodology used for switching two voltages to generate a bi-level current using cascaded power sources;

FIG. 1(*c*) is a chart of the associate driving waveforms;

FIG. 4(*b*) is a chart of experimental waveforms of the PWM control signal, $i_{PWM}$, and the corresponding forward voltage, $v_f$, and the forward current, $i_f$, of LED, for the buck converter operating at 10% duty cycle on $i_{PWM}$ with $I_H$=1000 mA and $I_L$=200 mA;

FIG. 5(*b*) is a chart of experimental waveforms of the PWM control signal, $i_{PWM}$, and the corresponding forward voltage, $v_f$, and the forward current, $i_f$, of LED, for the buck converter operating at 50% duty cycle on $i_{PWM}$ with $I_H$=1000 mA and $I_L$=200 mA;

FIG. 6(*b*) is a chart of experimental waveforms of the PWM control signal, $i_{PWM}$, and the corresponding forward voltage, $v_f$, and the forward current, $i_f$, of LED, for the buck converter operating at 90% duty cycle on $i_{PWM}$ with $I_H$=1000 mA and $I_L$=200 mA;

DETAILED DESCRIPTION OF THE DRAWINGS

Figure 1:
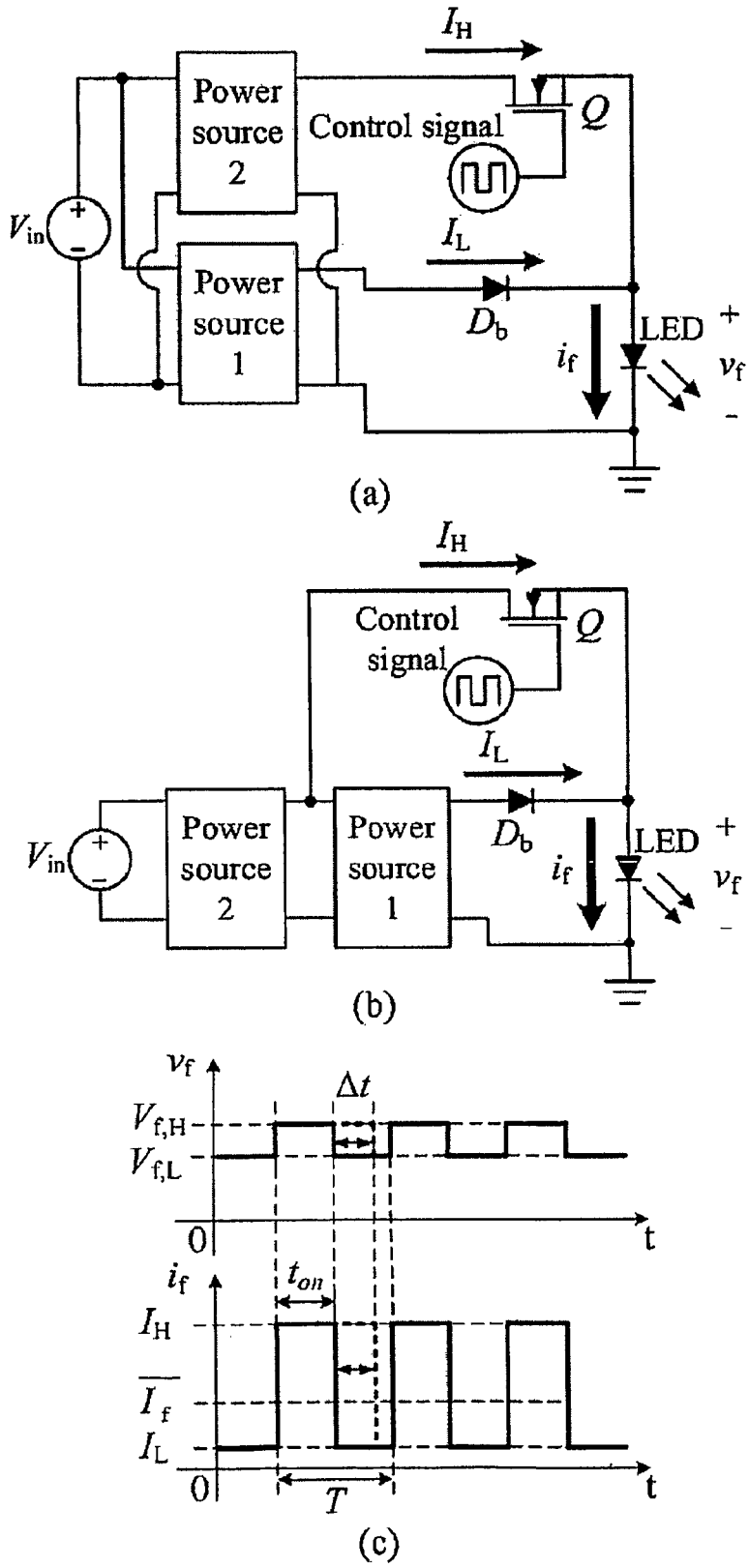
FIG. 1(*a*) is a schematic diagram of a driving methodology used for switching two voltages to generate a bi-level current using paralleled power sources.
Figure 2:
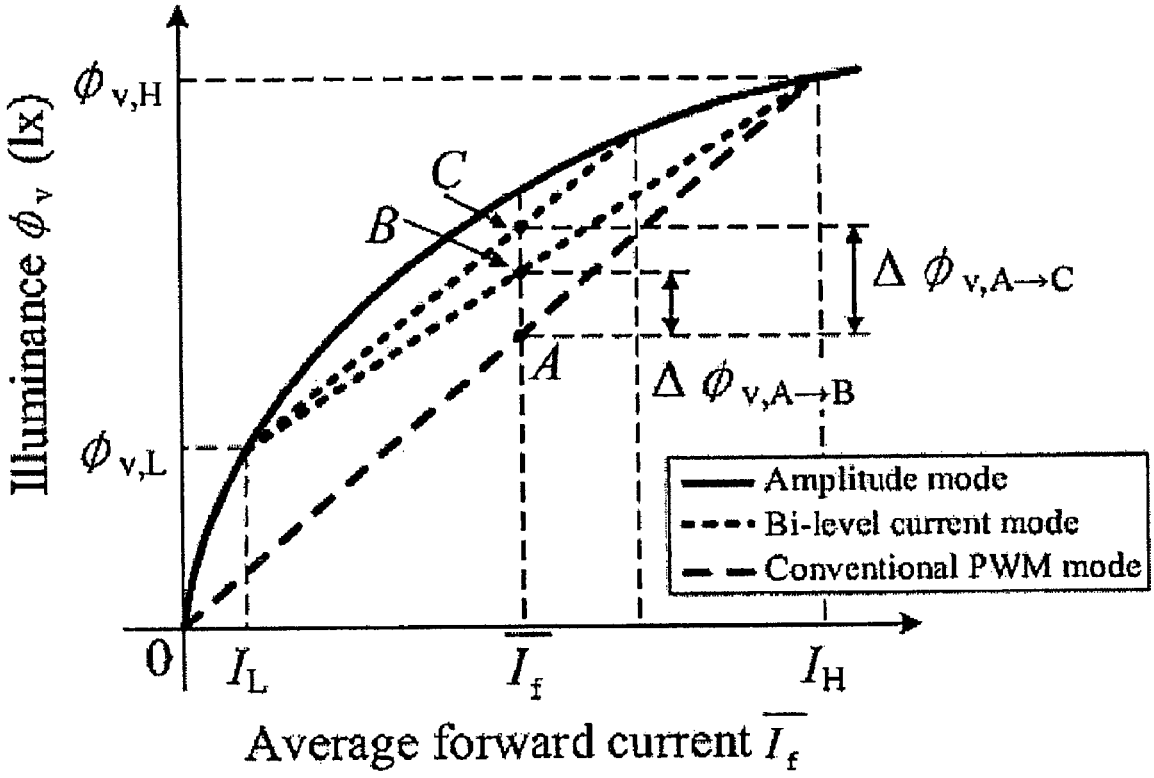
FIG. 2 is a chart of an improvement in LED illuminance using a bi-level current compared to a conventional PWM current.

Referring to the drawings, the luminous intensity of an LED driven by PWM mode can be improved by combinatory adjustment of the current levels (high current level, $I_H$, and low current level, $I_L$) and the duty cycle acting on the high current level $I_H$, where the two current levels is generated by the example circuit topologies shown in FIG. 1. In this example, the luminous intensity is measured in the unit of illuminance or lux (lx). The operating principle of the modified PWM driving technique is referred to as the bi-level current driving technique. Generally, the average current $\overline{I_f}$ and average illuminance $\overline{\phi_v}$ are given by $$\overline{I_f}=D\cdot I_H+(1-D)\cdot I_L \tag{1}$$

and $$\overline{\phi_v}=D\cdot\phi_{v,H}+(1-D)\cdot\phi_{v,L}. \tag{2}$$

The special case of $I_L$=0 and $\phi_{v,L}$=0 corresponds to the conventional PWM mode. Under this mode, assuming that the peak current used is $I_H$ and the duty cycle is adjusted to deliver an average current $\overline{I_f}$, the average illuminance $\overline{\phi_v}$ of the device will take place at point A.

When $I_L$ is raised above zero and the high current level remains at $I_H$ as in the previous step and the duty cycle is reduced to maintain the average current at $\overline{I_f}$, the new average illuminance $\overline{\phi_v}$ will now take place at point B, which advances an improvement $\Delta\phi_{v,A\rightarrow B}$. To proceed further, if the higher current level is lowered from $I_H$ while the lower current level remains at $I_L$ and the average current is maintained at $\overline{I_f}$ by enlarging the duty cycle, the new average illuminance $\overline{\phi_v}$ will now take place at point C, which advances a further improvement $\Delta\phi_{v,A\rightarrow C}$. Ultimately if the two steps are iterated indefinitely, the average illuminance $\overline{\phi_v}$ will eventually converge to the value corresponding to DC mode operating at $\overline{I_f}$ and the upper bound is reached.

The process described above can be repeated by first lowering the high current level $I_H$ while the low current level $I_L$ is fixed at zero, and the subsequent steps iterated in the same manner as above for illustration of another configuration by which the illuminance is improved.

To produce a bi-level current waveform, two voltages must be switched alternately across the LED. These voltages may be obtained from two independent power sources each supplying the required voltage (hence load current) level, or by periodically regulating the output voltage of a single power source at two voltage levels. The former approach involves two independent power sources which imply that the component count is doubled in comparison to a conventional PWM driver. The increased complexity and cost of the driver can be eased by using the latter approach.

Figure 3:
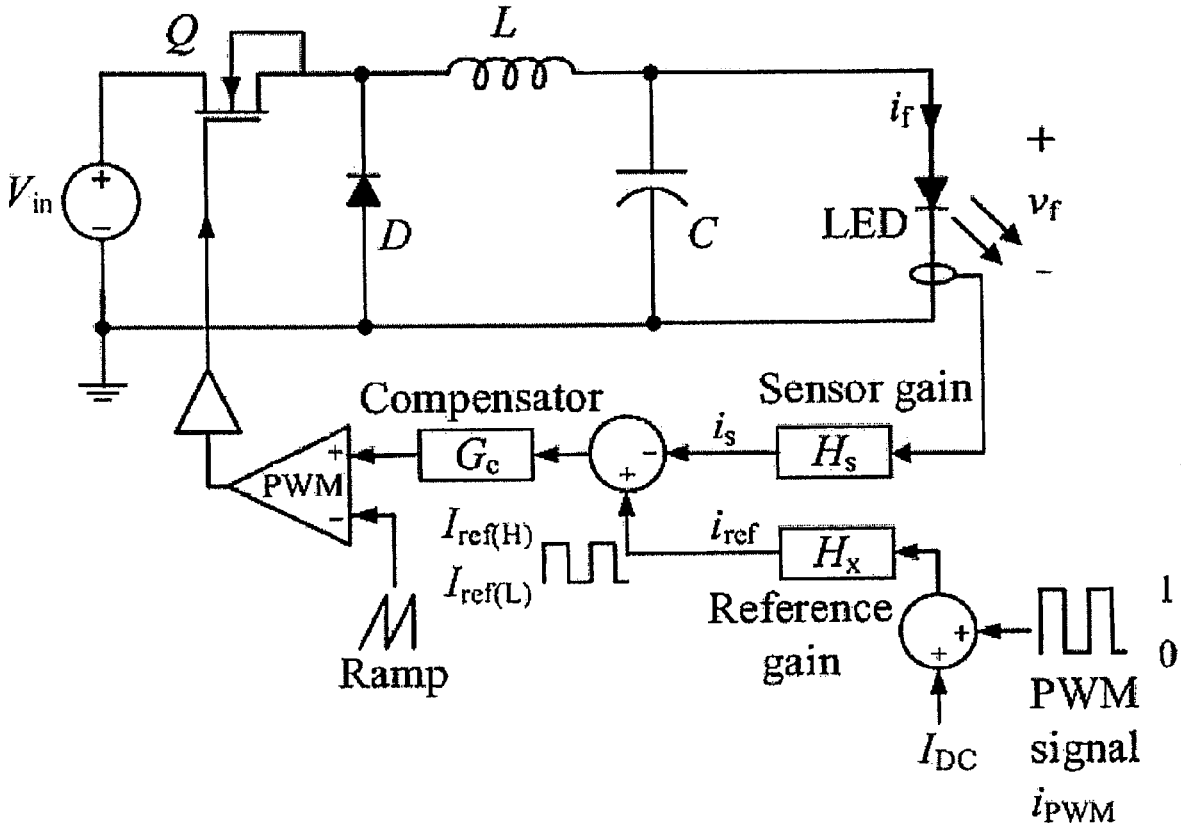
FIG. 3 is a circuit diagram of a buck converter having two output voltages for generating the bi-level current waveform.

Referring to FIG. 3, a current-control buck converter is used to implement the bi-level current driving technique. The LED current is regulated directly by using a current reference $i_{ref}$ switching between two levels, $I_{ref(H)}$ and $I_{ref(L)}$, through the use of an external PWM signal, $i_{PWM}$, for each loading condition corresponding to $I_H$ and $I_L$.

Figure 4:
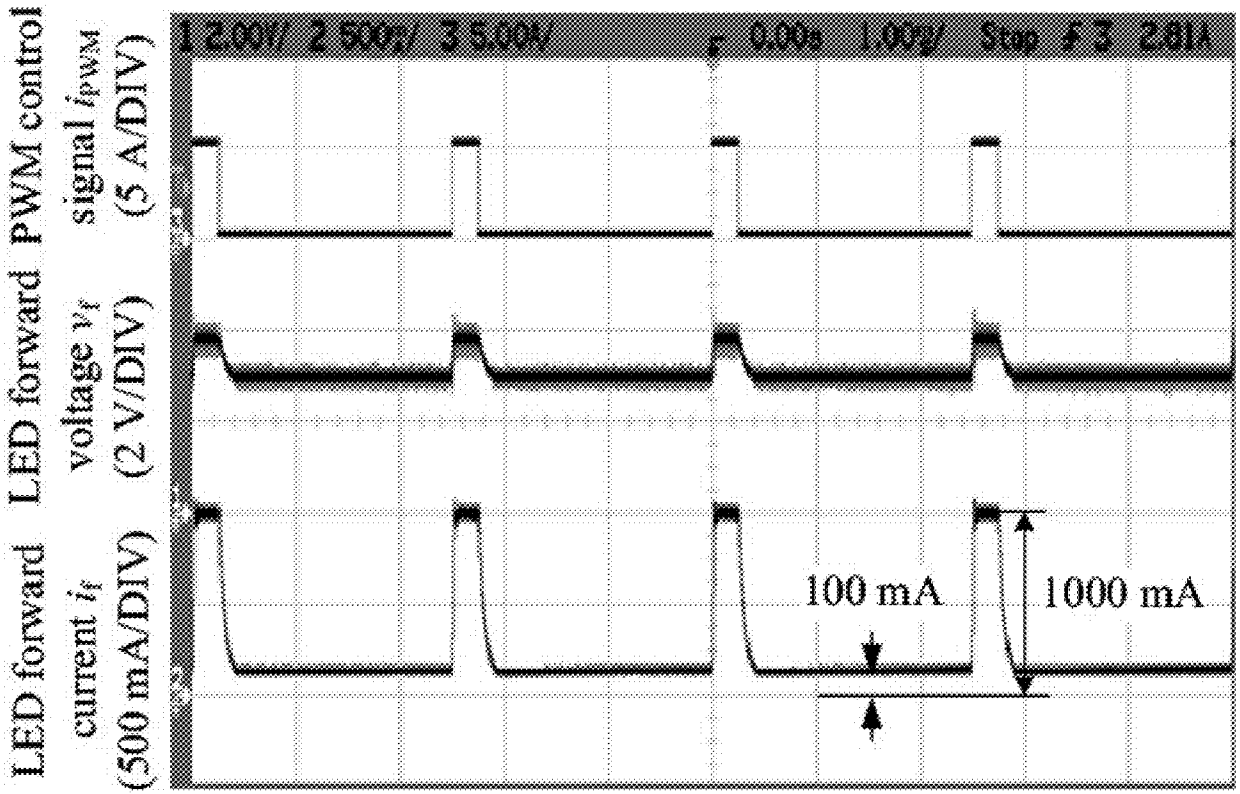
FIG. 4(*a*) is a chart of experimental waveforms of the PWM control signal, $i_{PWM}$, and the corresponding forward voltage, $v_f$, and the forward current, $i_f$, of LED, for the buck converter operating at 10% duty cycle on $i_{PWM}$ with $I_H$=1000 mA and $I_L$=100 mA.
Figure 4:
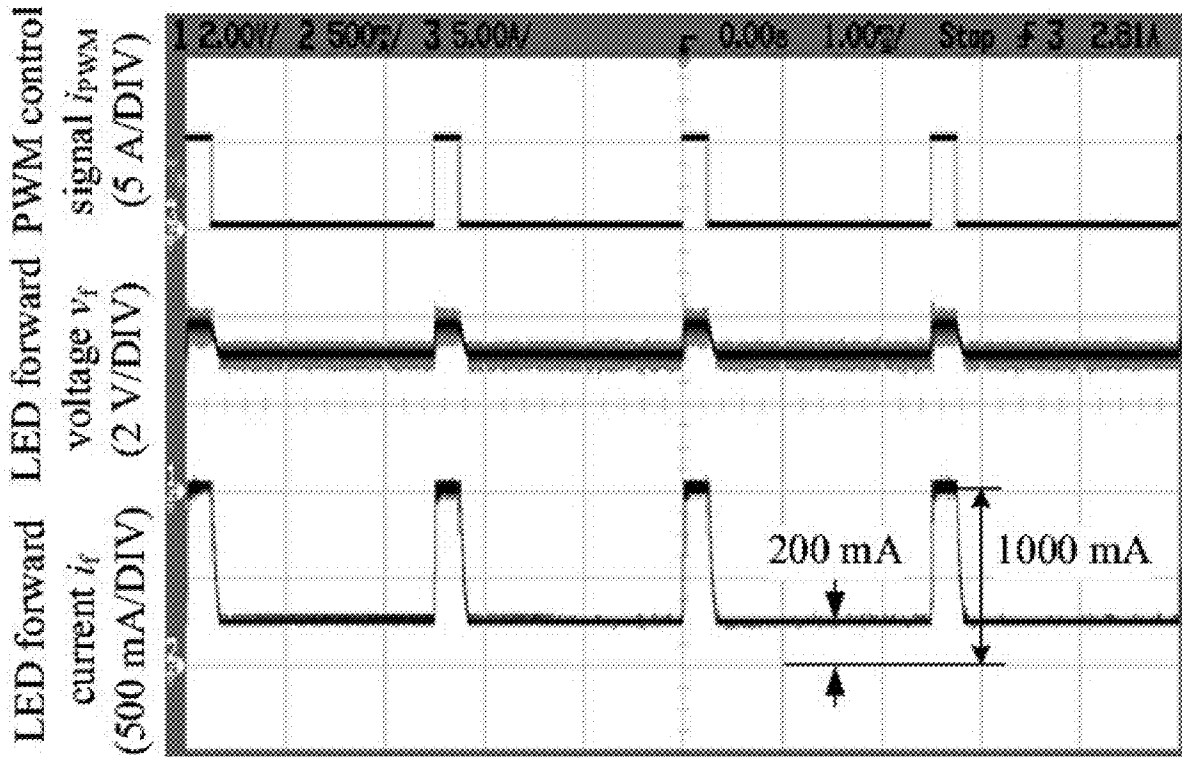
Figure 5:
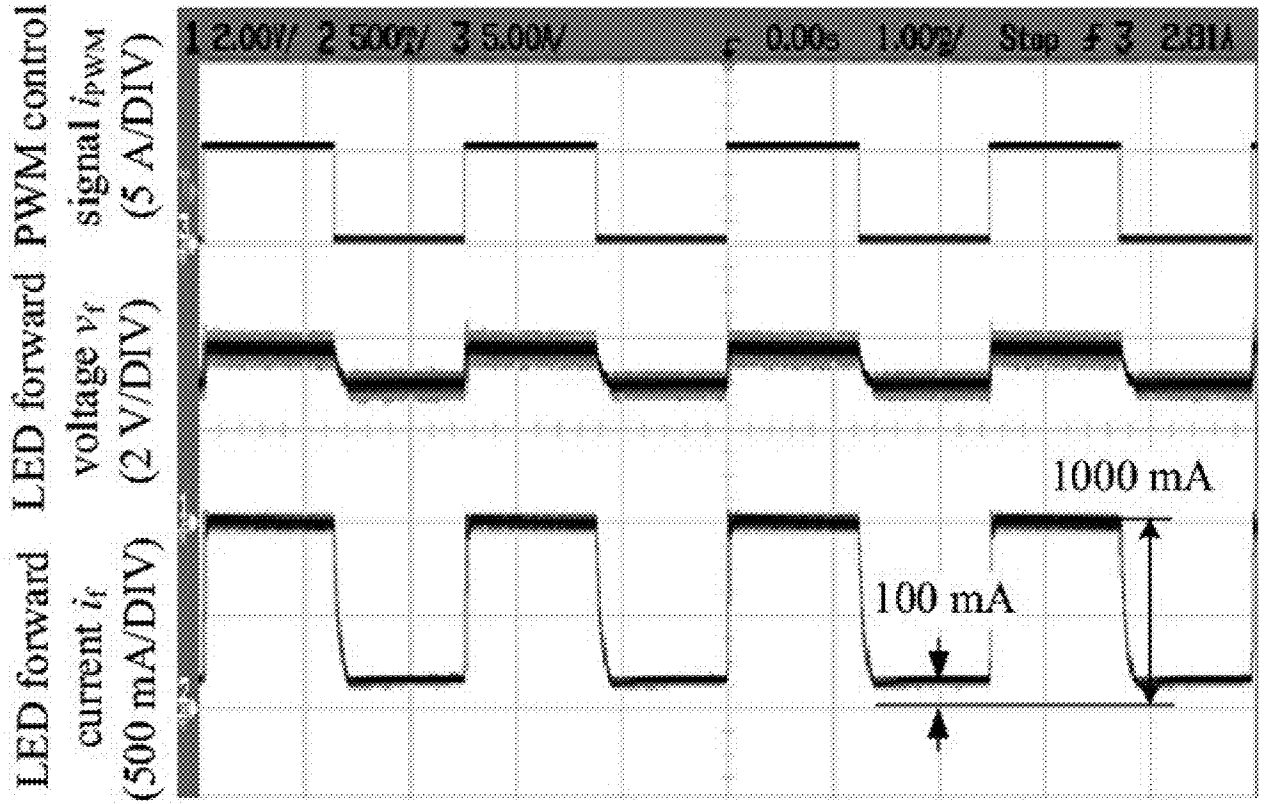
FIG. 5(*a*) is a chart of experimental waveforms of the PWM control signal, $i_{PWM}$, and the corresponding forward voltage, $v_f$, and the forward current, $i_f$, of LED, for the buck converter operating at 50% duty cycle on $i_{PWM}$ with $I_H$=1000 mA and $I_L$=100 mA.
Figure 5:
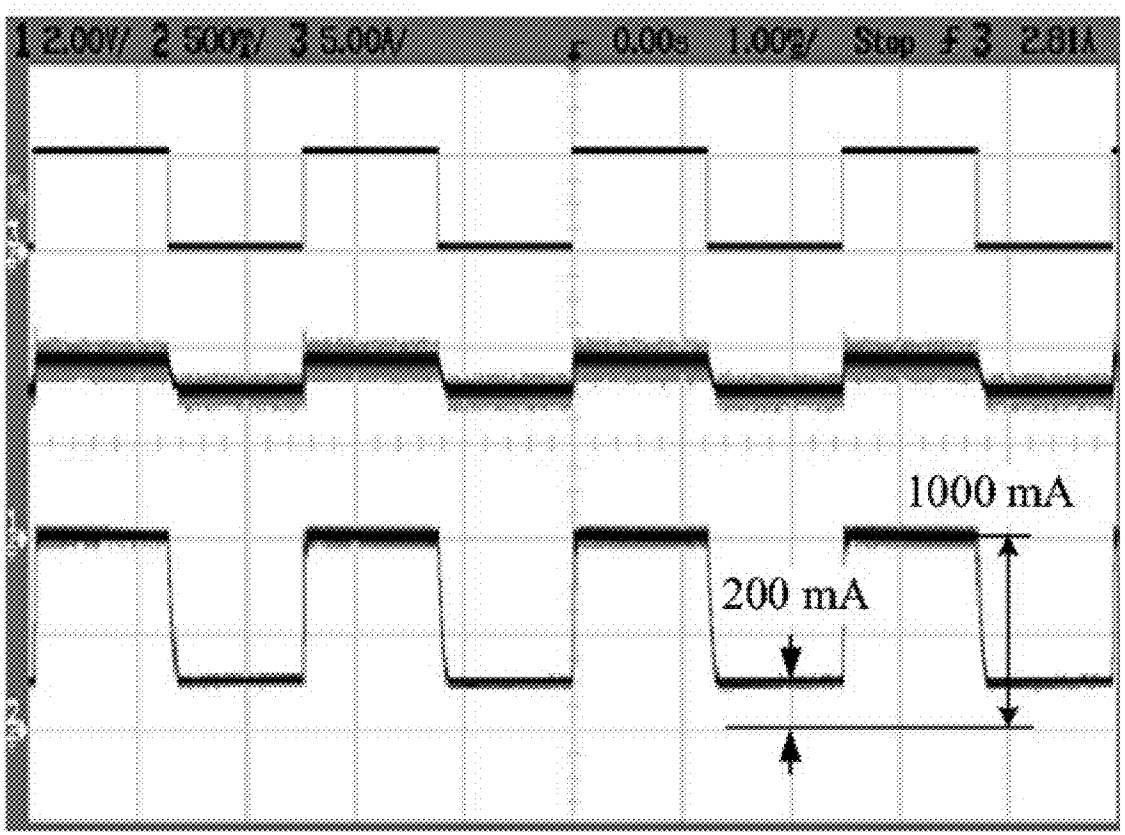
Figure 6:
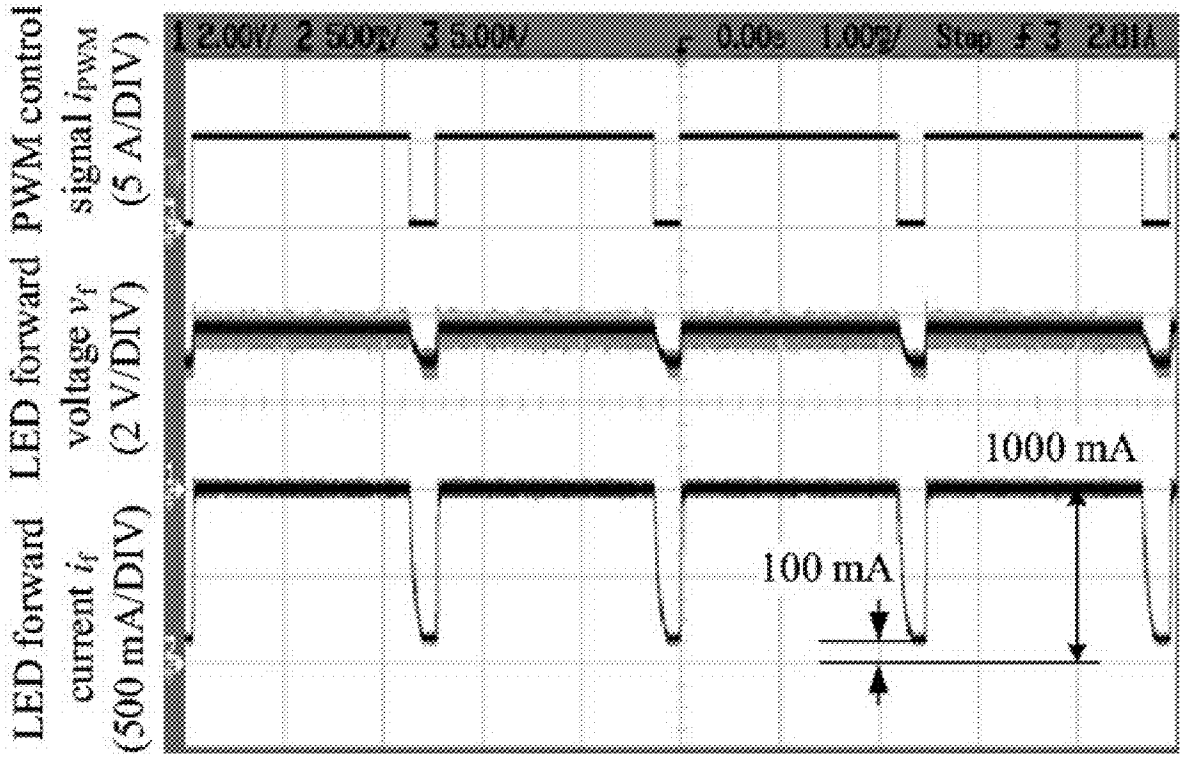
FIG. 6(*a*) is a chart of experimental waveforms of the PWM control signal, $i_{PWM}$, and the corresponding forward voltage, $v_f$, and the forward current, $i_f$, of LED, for the buck converter operating at 90% duty cycle on $i_{PWM}$ with $I_H$=1000 mA and $I_L$=100 mA.
Figure 6:
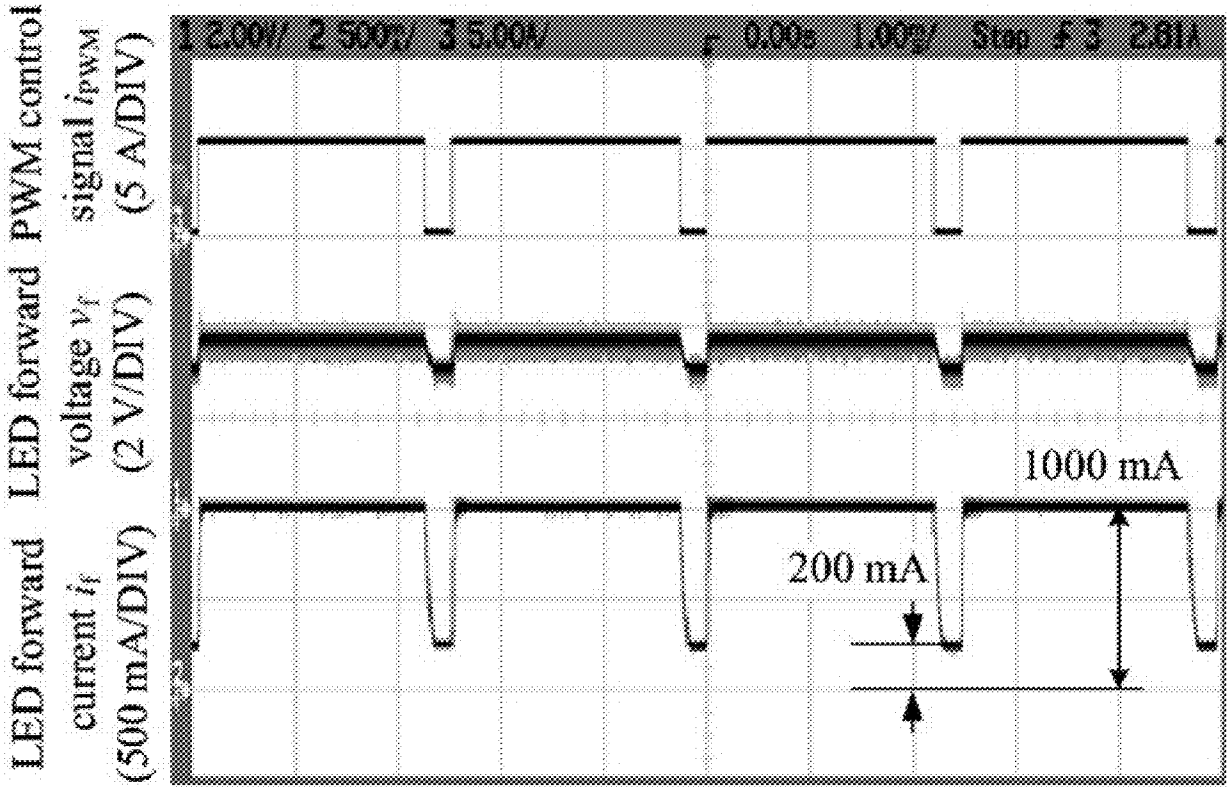

FIGS. 4 to 6 show the voltage and current waveforms of the LED with PWM signal $i_{PWM}$ at 10%, 50% and 90% duty cycle, where part (*a*) and (*b*) of the Figures refer to the cases of $I_L$=100 mA and 200 mA respectively while $I_H$=1000 mA is maintained in all cases. At these current levels, the forward voltage across the LED $V_f$ is 2.8 V (for $I_f$=100 mA), 2.95 V (for $I_f$=200 mA), and 3.65 V (for $I_f$=1000 mA). The measured maximum efficiency of the converter is 87.58% under 70% current load, the efficiency is over 86.82% for all loading conditions.

Experimental Results

Figure 7:
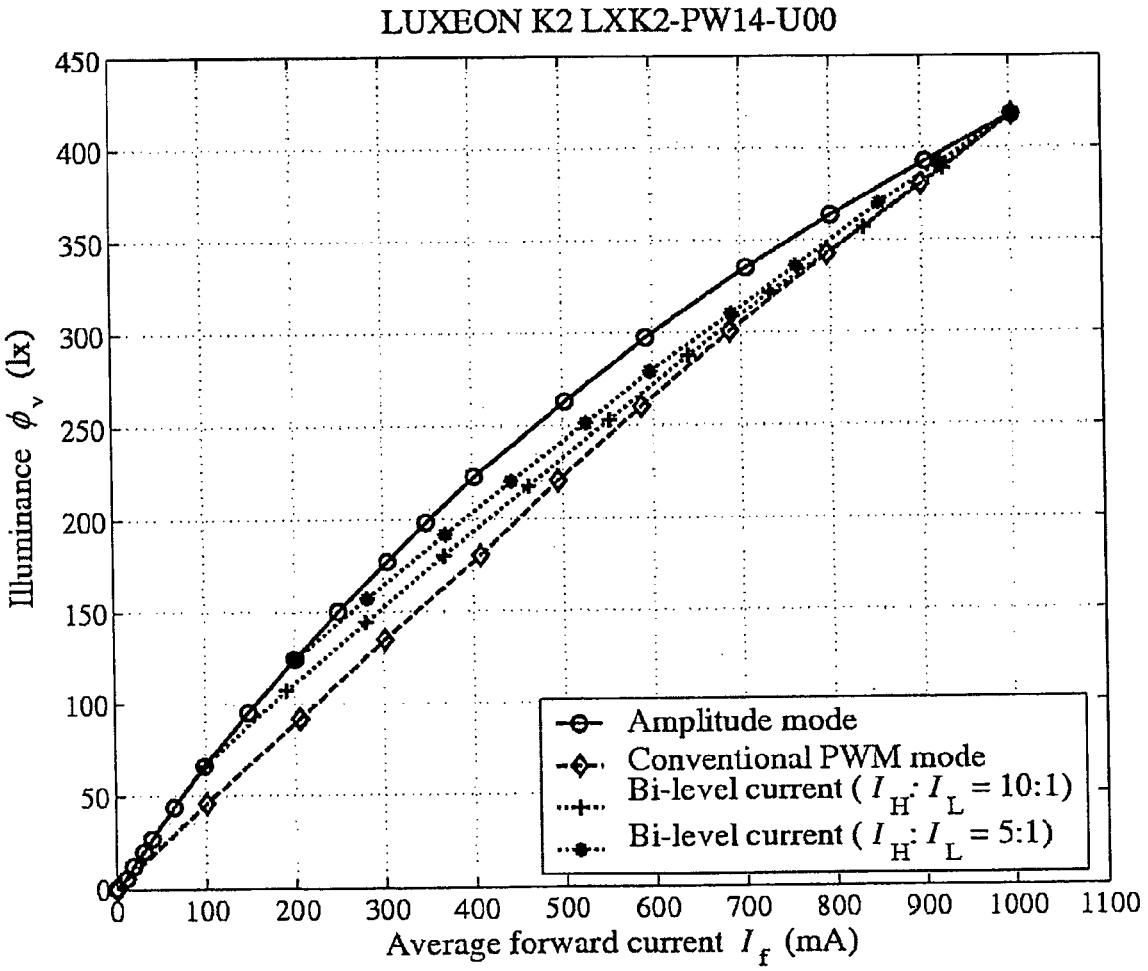
FIG. 7 is a chart of the illuminance $\phi_v$ of LUXEON K2 LXK2-PW14-U00 measured under amplitude-mode, conventional PWM-mode and bi-level current driving techniques.

By using the current-control buck converter, two LEDs (Lumileds LUXEON and CREE XLAMP) were operated with the bi-level current driving technique at two current configurations, and comparison with the two conventional techniques were made on the illuminance and illuminance efficacy performances. The two configurations used for the bi-level current are summarized below:

1) $I_H$:$I_L$=10:1; $I_H$=1000 mA and $I_L$=100 mA
2) $I_H$:$I_L$=5:1; $I_H$=1000 mA and $I_L$=200 mA FIG. 7 show the results of illuminance measurement for Lumileds LUXEON and FIG. 8 for CREE XLAMP. For both LEDs, the illuminance curves obtained under amplitude-mode operation have acquired a shape resembling an exponentially growing function with DC current, whereas for conventional PWM-mode operation, the (average) illuminance varies linearly with the (average) current. The linearity for the latter stems from the artifactual averaging of the peak illuminance (at $I_H$=1000 mA) using various duty cycles. The illuminance characteristics of both conventional techniques meet at $I_f$=$\overline{I_f}$=0 and 1000 mA as the two techniques essentially conform to each other under these conditions. The area enclosed by these curves defines the working area of the bi-level current driving technique. This is in agreement with the measured data shown in FIGS. 7 and 8.

Since the bi-level current driving technique is derived from the conventional PWM technique, the linearity between the average illuminance and the average current is maintained. As $I_L$ is increased from zero (for conventional PWM) to 100 mA (for bi-level current), it is evident from the data that the illuminance performance is improved accordingly. Such an improvement becomes more significant when $I_L$ is further increased to 200 mA. This is an intuitively correct result as the additional light output produced by $I_L$ is expected to contribute constructively to the average illuminance. If $I_H$ is held constant while $I_L$ is increased from zero, the duty cycle acting on $I_H$ must be decreased in order to maintain the same average current $\overline{I_f}$ as the conventional PWM mode. Since LEDs exhibit a decreasing $\partial\phi_v/\partial I_f$ behavior at increasing current, this effectively reduces the weight of the less efficacious contribution of illuminance from $I_H$, and increases the more efficacious contribution from $I_L$.

Figure 8:
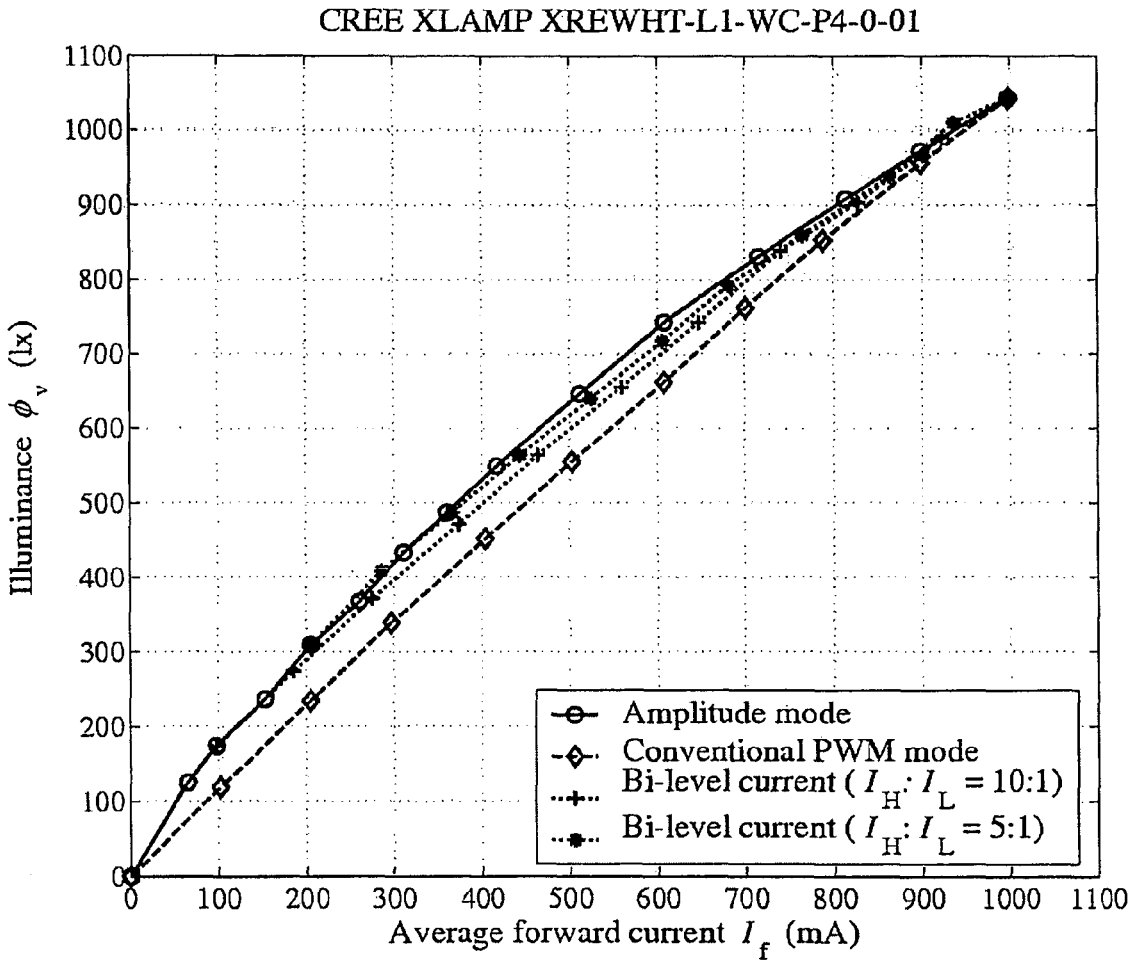
FIG. 8 is a chart of the illuminance $\phi_v$ of CREE XLAMP XREWHT-L1-WC-P4-0-01 measured under amplitude-mode, conventional PWM-mode and bi-level current driving techniques.
Figure 9:
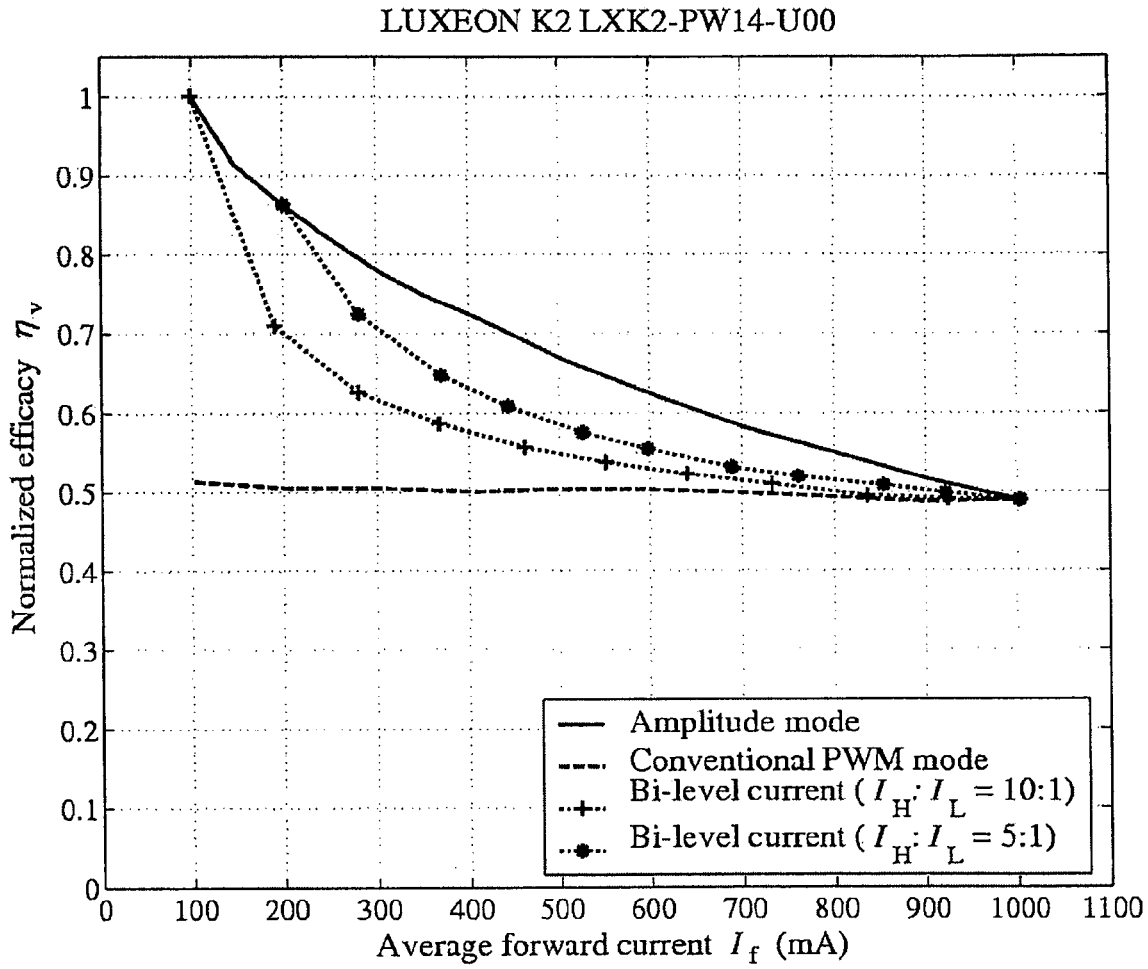
FIG. 9 is a chart of the normalized efficacy $\eta_v$ of LUXEON K2 LXK2-PW14-U00 measured by applying bi-level current driving technique ($I_H$:$I_L$=5:1), ($I_H$:$I_L$=10:1) and other conventional driving techniques.
Figure 10:
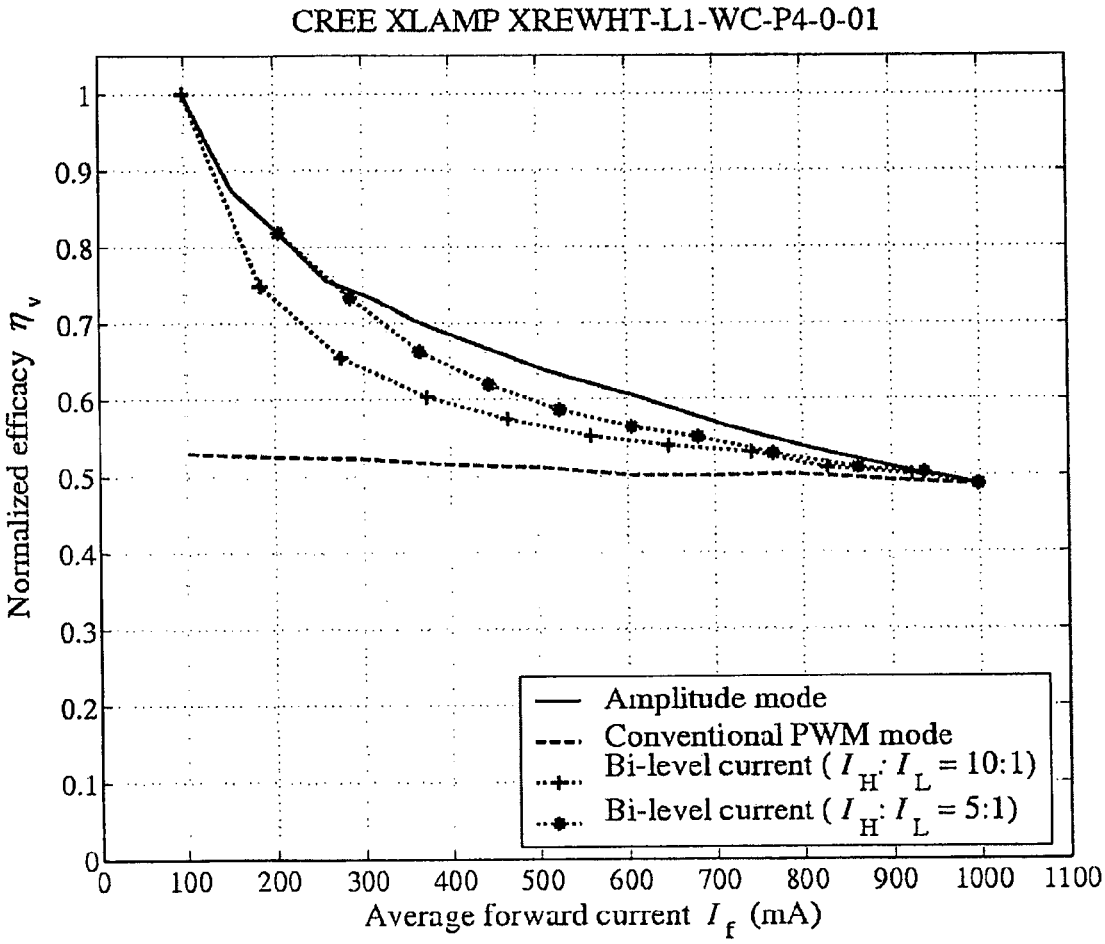
FIG. 10 is a chart of the normalized efficacy $\eta_v$ of CREE XLAMP XREWHT-L1-WC-P4-0-01 measured by applying bi-level current driving technique ($I_H$:$I_L$=5:1), ($I_H$:$I_L$=10:1) and other conventional driving techniques.

The illuminance efficacy is calculated from the data shown in FIGS. 7 and 8 and the measured power dissipation of LEDs at various average currents. The efficacy curves for Lumileds LUXEON and CREE XLAMP are plotted in FIGS. 9 and 10 respectively, where the curves shown are normalized to their respective maximum efficacy under amplitude-mode operation at 100 mA. In general the bi-level current driving technique performs better than the conventional PWM technique, with the efficacy improving as $I_L$ is increased from zero to 200 mA following the same reason as discussed above for the illuminance. For the case with $I_L$=100 mA, its efficacy at $\overline{I_f}$=100 mA (duty cycle=0%, $\overline{I_f}$=$I_L$) and 1000 mA (duty cycle=100%, $\overline{I_f}$=$I_H$) coincides with those of the DC mode at the same current because the bi-level current driving technique essentially conforms to DC mode at these operating points. The same applies to the case with $I_L$=200 mA.

The improvement in the illuminance with the bi-level current driving technique is not without drawbacks. Reducing the difference between the two current levels involved in the PWM current, $I_H$ and $I_L$, unavoidably strains the dynamic range over which the illuminance of LEDs can be varied since the minimum illuminance is prescribed by the level chosen for $I_L$. Therefore the selection of $I_H$ and $I_L$ requires a trade-off between the amount of illuminance (or efficacy) improvement desired and the dynamic range needed to ensure sufficient control headroom.

It will be appreciated by persons skilled in the art that numerous variations and/or modifications may be made to the invention as shown in the specific embodiments without departing from the scope or spirit of the invention as broadly described. The present embodiments are, therefore, to be considered in all respects illustrative and not restrictive.

We claim:

1. A driving method for improving luminous efficacy of a light emitting diode (LED), the method comprising:

periodically switching a DC current supplied to the LED between a high current level $I_H$ and a low current level $I_L$, the low current level $I_l$ being fixed at zero or raised above zero to produce a DC offset; and maintaining an average current at a first value $\bar{I}_f$ by adjusting the duty cycle acting the high current level $I_H$ and any one from the grouping consisting of:

adjusting the high current level $I_H$ and adjusting the low current level $I_L$, and adjusting the high current level $I_H$ or adjusting the low current level $I_L$, wherein the DC current supplied to the LED ensures that the LED always emits light and the luminous efficacy is improved by reducing the duty cycle applied to the high current level $I_H$.

2. The method according to claim 1, wherein the high current level $I_H$ is maintained and the low current level $I_L$ is increased and the duty cycle acting on the high current level $I_H$ is reduced to maintain an average current at the first value $\bar{I}_f$.

3. The method according to claim 1, wherein the low current level $I_L$ is maintained and the high current level $I_H$ is reduced and the duty cycle acting on the high current level $I_H$ is increased to maintain the average cuttent at the first value $\bar{I}_f$.

4. The method according to claim 1, wherein the low current level $I_L$ is increased and the high current level $I_H$ is reduced at the same time and the duty cycle acting on the high current level $I_H$ is adjusted to maintain an average current at the first value $\bar{I}_f$.

5. The method according to claim 1, wherein the LED is driven by two independent power sources, each being set to deliver the high current level $I_H$ and the low current level $I_L$ respectively, and an independent switching network is used to adjust the duty cycle acting on the high current level $I_H$.

6. The method according to claim 5, wherein the LED is driven by a single power source with two output voltages.

7. A driving system for improving luminous efficacy of a light emitting diode (LED), the system comprising:

a switching network to periodically switch a DC current supplied to the LED between a high current level $I_H$ and a low current level $I_L$, the low current level $I_L$ being fixed at zero or raised above zero to produce a DC offset; and to maintain an average current at a first value $\bar{I}_f$ by adjusting the duty cycle acting on the high current level $I_H$ and any one from the grouping consisting of:

adjusting the high current level $I_H$ and adjusting the low current level $I_L$, and adjusting the high current level $I_H$ or adjusting the low current level $I_L$.

8. The method according to claim 1 including repeatedly adjusting the high current level $I_H$ and the low current level $I_L$ to make an average luminance of the LED approach a luminance of the LED operating in a DC mode at $\bar{I}_f$.

9. A driving method for improving luminous efficacy of a light emitting diode (LED), the method comprising:

periodically switching a DC current supplied to the LED between a high current level $I_H$ and a low current level $I_L$, the low current level $I_L$ being fixed at zero or raised above zero to produce a DC offset; and maintaining an average current at a first value $\bar{I}_f$ by adjusting the duty cycle acting on the high current level $I_H$ while changing the high current level $I_H$ or while changing the low current level $I_L$ or while changing both the high current level $I_l$ and the low current level $I_L$ at the same time.

10. The method according to claim 9, wherein the high current level $I_H$ is maintained and the duty cycle acting on the high current level $I_H$ is reduced while increasing the low current level $I_L$ to maintain an average current level at the first value $\bar{I}_f$.

11. The method according to claim 9, wherein the low current level $I_L$ is maintained and the duty cycle acting on the high current level $I_H$ is increased while the high current level $I_H$ is reduced to maintain the average current at the first value $\bar{I}_f$.

12. The method according to claim 9, wherein the duty cycle acting on the high currrent level $I_H$ is adjusted to maintain an average current at the first value $\bar{I}_f$ while the low current level lL is increased and the high current level lH is reduced at the same time.

13. The method according to claim 9,wherein the LED is driven by two independent power sources, each being set to deliver the high current level $I_H$ and the low current level $I_L$ respectively, and an independent switching network is used to adjust the duty cycle acting on the high current level $I_H$.

14. The method according to claim 13, wherein the LED is driven by a single power source with two output voltages.

15. The method according to claim 9 including repeatedly adjusting the high current level $I_H$ and the low current level $I_L$ to make an average luminance of the LED approach a luminance of the LED operating in a DC mode at $\bar{I}_f$.

16. A driving system for improving luminous efficacy of a light emitting diode (LED), the system comprising:

a switching network to periodically switch a DC current supplied to the LED between a high current level $I_H$ and a low current level $I_L$, the low current level being fixed at zero or raised above zero to produce a DC offset, and to maintain an average current at a first value $\bar{I}_f$ by adjusting the duty cycle acting on the high current level $I_H$ while changing the high current level $I_H$ or while changing the low current level $I_L$ or while changing both the high current level $I_H$ and the low current level $I_L$ at the same time.

17. The method according to claim 16 including repeatedly adjusting the high current level $I_H$ and the low current level $I_L$ to make an average luminance of the LED approach a luminance of the LED operating in a DC mode at $\bar{I}_f$.

* * * * *